US009394132B2

(12) United States Patent
Kobayashi

(10) Patent No.: US 9,394,132 B2
(45) Date of Patent: Jul. 19, 2016

(54) CONVEYING DEVICE AND PRINTING APPARATUS

(71) Applicant: CANON KABUSHIKI KAISHA, Tokyo (JP)

(72) Inventor: Ryo Kobayashi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/595,875

(22) Filed: Jan. 13, 2015

(65) Prior Publication Data

US 2015/0197081 A1 Jul. 16, 2015

(30) Foreign Application Priority Data

Jan. 14, 2014 (JP) ..... 2014-003878

(51) Int. Cl.
*B41J 13/10* (2006.01)
*B65H 29/14* (2006.01)

(52) U.S. Cl.
CPC ..... *B65H 29/14* (2013.01); *B41J 13/106* (2013.01); *B65H 2404/1115* (2013.01); *B65H 2404/134* (2013.01); *B65H 2404/1416* (2013.01); *B65H 2404/1431* (2013.01); *B65H 2404/17* (2013.01); *B65H 2601/254* (2013.01); *B65H 2801/06* (2013.01)

(58) Field of Classification Search
CPC ..... B41J 11/00; B41J 13/00; B41J 13/02; B41J 2/01; B41J 13/106; B65H 2404/1115; B65H 2404/1431; B65H 2404/1416; B65H 2404/134; B65H 2404/17; B65H 2601/254
See application file for complete search history.

(56) References Cited

U.S. PATENT DOCUMENTS 5,606,357 A * 2/1997 Bekki ..... B41J 13/076 271/274
5,961,234 A * 10/1999 Uchikata ..... B41J 13/02 347/104
6,062,685 A * 5/2000 Ohyama ..... B41J 29/17 101/425
6,554,417 B2 * 4/2003 Lin ..... B41J 13/02 347/104
2003/0048345 A1 * 3/2003 Matsumoto ..... B41J 11/005 347/104
2003/0210315 A1 * 11/2003 Uwagaki ..... B41J 13/14 347/104
2006/0139430 A1 * 6/2006 Izuchi ..... B41J 13/076 347/104
2006/0198684 A1 * 9/2006 Buxton ..... B41J 13/02 400/636
2013/0256984 A1 * 10/2013 Samoto ..... B41J 13/00 271/225
2013/0286127 A1 * 10/2013 Samoto ..... B41J 11/007 347/104

FOREIGN PATENT DOCUMENTS

JP S58-016876 A 1/1983
JP H07-277571 A 10/1995
JP 2001058749 A * 3/2001
JP 2002096513 A * 4/2002
JP 2002179319 A 6/2002
JP 2002241010 A 8/2002
JP 2006-347119 A 12/2006
JP 2006347117 A * 12/2006

* cited by examiner

*Primary Examiner* — David Banh
(74) *Attorney, Agent, or Firm* — Canon USA Inc. IP Division

(57) ABSTRACT

A conveying device includes a rotating member having sharp teeth and configured to rotate while being in contact with an object that is being conveyed, and a holder configured to support the rotating member. When seen from a downstream side in a direction of sheet conveyance, the rotating member is rotatably supported by the holder such that the rotating member is allowed to incline toward one side but is prevented from inclining toward an opposite side. The teeth of the rotating member each have an asymmetrical shape with the one side thereof sloping.

7 Claims, 7 Drawing Sheets

FIG. 4

| | INCLINING TOWARD SIDE B | STANDING VERTICALLY | INCLINING TOWARD SIDE A |
|---|---|---|---|
| SPUR | B | | A |
| TOOTH EDGE | | | |
| SPUR MARK | $L_2$ | $L_0$ | $L_1$ |
| EVALUATION OF SPUR MARK | OK | OK | NG |

CONVEYING DEVICE AND PRINTING APPARATUS

BACKGROUND OF THE INVENTION

1. Field of the Invention

The present invention relates to a conveying device and a printing apparatus including the conveying device.

2. Description of the Related Art

In a known printing apparatus, a sheet that has undergone printing is conveyed while being nipped between a set of discharge rollers (conveying rollers) and a set of spurs (rotating bodies). The spurs each have sharp teeth (edges) and rotate while biting the surface of the sheet.

Such a conveying device is disclosed by Japanese Patent Laid-Open No. 2006-347119. The conveying device includes a spur holder that supports spurs while allowing the rotation of the spurs and that prevents the spurs from moving in a thrust direction (axial direction), whereby the spurs are supported in such a manner as to stand substantially vertically to the sheet.

The conveying device disclosed by Japanese Patent Laid-Open No. 2006-347119 is intended to support each of the spurs as vertically as possible. To allow the spur to rotate smoothly, however, a clearance is necessarily provided between the spur and the spur holder. The spur can take various positions within the clearance. That is, as illustrated in FIG. 8 of Japanese Patent Laid-Open No. 2006-347119, the spur inclines in the horizontal direction to some extent when seen from the downstream side in the direction of sheet conveyance.

In some cases, the sharp teeth of the spur each have an asymmetrical shape, when seen from the downstream side in the direction of sheet conveyance, with only one side thereof having a slope and the opposite side thereof not having a slope. This is because of the easiness in manufacturing a sharp edge of the spur.

If such a spur having asymmetrically shaped teeth is supported by the spur holder disclosed by Japanese Patent Laid-Open No. 2006-347119, marks that are made when the teeth of the spur bite the surface of the sheet may become large depending on the direction of inclination of the spur. Consequently, the damage to the sheet may increase. Such a mechanism will be described in detail in the description of embodiments.

The present invention is based on the recognition of the above problem and provides a conveying device in which the damage to a sheet that is caused by a spur is reduced.

SUMMARY OF THE INVENTION

According to an aspect of the present invention, a conveying device includes a rotating member having sharp teeth and configured to rotate while being in contact with an object that is being conveyed, and a holder configured to support the rotating member. When seen from a downstream side in a direction of sheet conveyance, the rotating member is rotatably supported by the holder such that the rotating member is allowed to incline toward one side but is prevented from inclining toward an opposite side. The teeth of the rotating member each have an asymmetrical shape with the one side thereof sloping.

Further features of the present invention will become apparent from the following description of exemplary embodiments with reference to the attached drawings.

BRIEF DESCRIPTION OF THE DRAWINGS

FIG. 4 is a table summarizing the relationship between the inclination of the spur and the shape of the resultant spur mark made in the sheet;

DESCRIPTION OF THE EMBODIMENTS

A printing apparatus that conveys a sheet and performs printing on the sheet will now be described as an exemplary embodiment of the present invention. The present invention is not limited to the printing apparatus to be described below and is also applicable to a conveying device that conveys any of various objects other than a sheet.

First Embodiment

Figure 1:
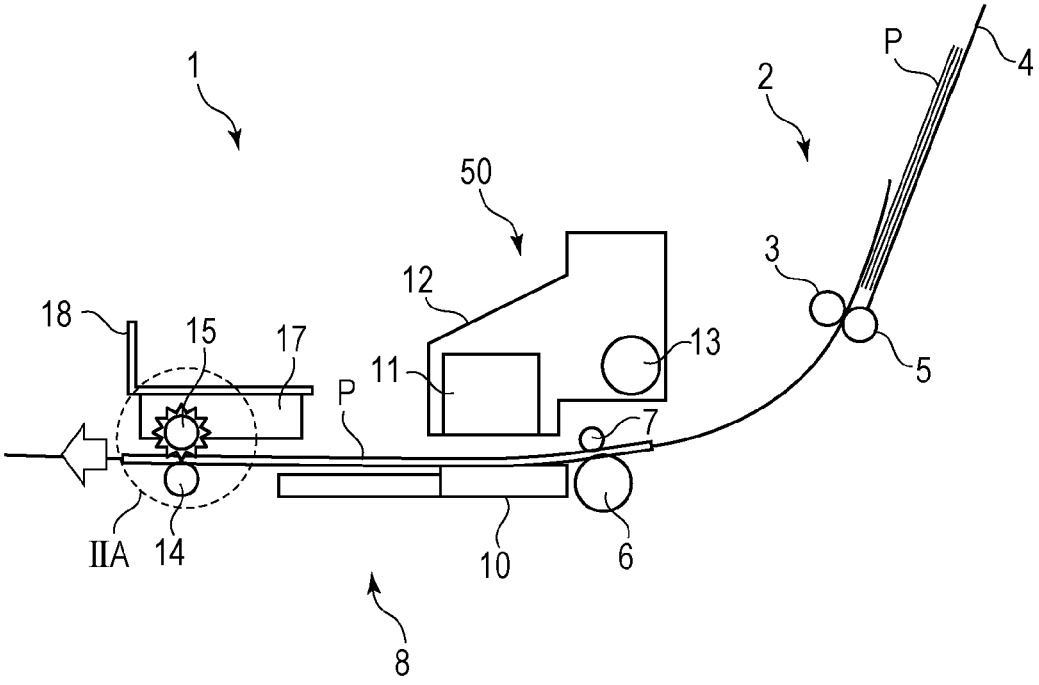
FIG. 1 is a general view of a printing apparatus according to a first embodiment.

FIG. 1 is a general view of a printing apparatus 1 according to a first embodiment. The printing apparatus 1 includes a sheet feeding section 2 that feeds a sheet from a stack of sheets, a sheet conveying section 8 that conveys the sheet to a position below a printing section 50, and the printing section 50 that ejects ink toward the surface of the sheet. A side of the printing apparatus 1 on which the sheet feeding section 2 is provided is defined as the upstream side in the direction of sheet conveyance, and a side of the printing apparatus 1 on which the sheet conveying section 8 is provided is defined as the downstream side in the direction of sheet conveyance.

The sheet feeding section 2 includes a tray 4 on which a plurality of sheets P are stacked, a feed roller 3 that feeds one of the stack of sheets P toward the sheet conveying section 8, and a separating roller 5 that faces the feed roller 3 and is made of a highly frictional member. When the feed roller 3 is rotated by a driving force generated by a feed motor (not illustrated), a top one of the sheets P is fed toward the downstream side. The other sheets P lying under the top one are prevented from being fed toward the downstream side by the separating roller 5, whereby the occurrence of double feed is prevented.

The sheet conveying section 8 includes a conveying roller 6, an idler roller 7 that faces the conveying roller 6 and nips the sheet P in combination with the conveying roller 6, and a platen 10 that faces a print head 11. The sheet conveying section 8 further includes a conveying roller 14 provided on the downstream side with respect to the platen 10, and a spur 15 that faces the conveying roller 14 and nips the sheet P in combination with the conveying roller 14. The spur 15 is held by a spur holder 17. The spur holder 17 is fixed to a housing 18 of the printing apparatus 1.

The sheet P is conveyed onto the platen 10 while being nipped between the conveying roller 6 that is rotated by a driving force generated by a conveyance motor (not illustrated) and the idler roller 7 that rotates by following the rotation of the conveying roller 6. Subsequently, printing is performed in which ink is ejected from the print head 11 toward the surface of the sheet P that has been conveyed onto the platen 10. The sheet P having undergone printing is conveyed toward the downstream side, is nipped between the conveying roller 14 and the spur 15, and is discharged from the printing apparatus 1. The conveying roller 14 is rotated by the driving force generated by the conveyance motor (not illustrated), which is shared with the conveying roller 6. The spur 15 rotates by following the rotation of the conveying roller 14.

The printing section 50 includes the print head 11 that is of an inkjet type and ejects ink toward the sheet P, a carriage 12 that carries the print head 11, and a guiding shaft 13 that supports the carriage 12 and extends in a direction orthogonal to the direction of sheet conveyance (a direction perpendicular to the plane of the page of FIG. 1). The carriage 12 moves back and forth along the guiding shaft 13 by receiving the power of a carriage motor (not illustrated). While the carriage 12 is moving back and forth, ink is ejected from the print head 11 toward the sheet P, whereby an image is printed on the sheet P. The present invention is not limited to the inkjet method and is also applicable to various other printing methods in each of which a sheet is conveyed and printing is performed on the sheet.

Figure 2A:
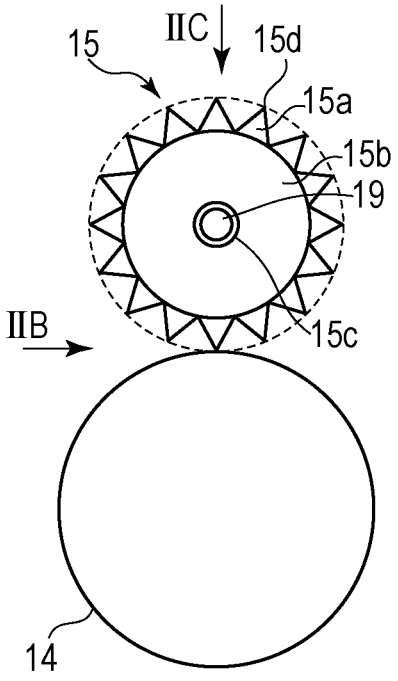
FIGS. 2A to 2C are detailed views illustrating a spur and associated elements (in a state where no sheet is being conveyed)
Figure 2B:
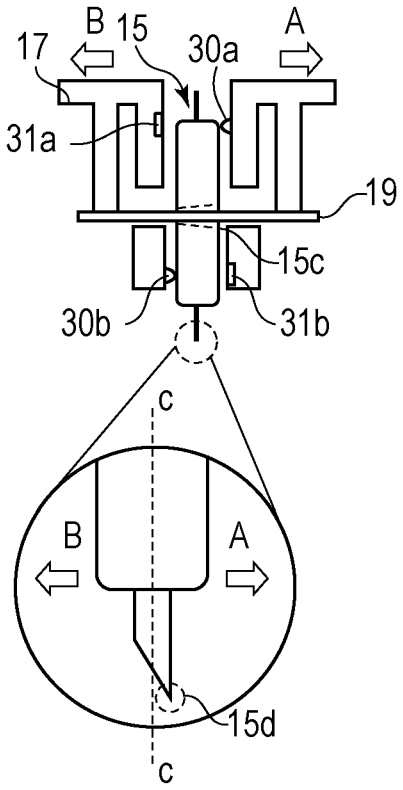
Figure 2C:
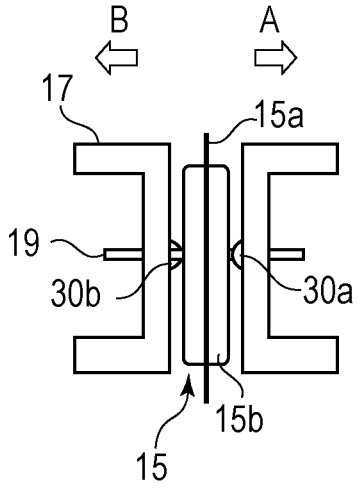
Figure 3:
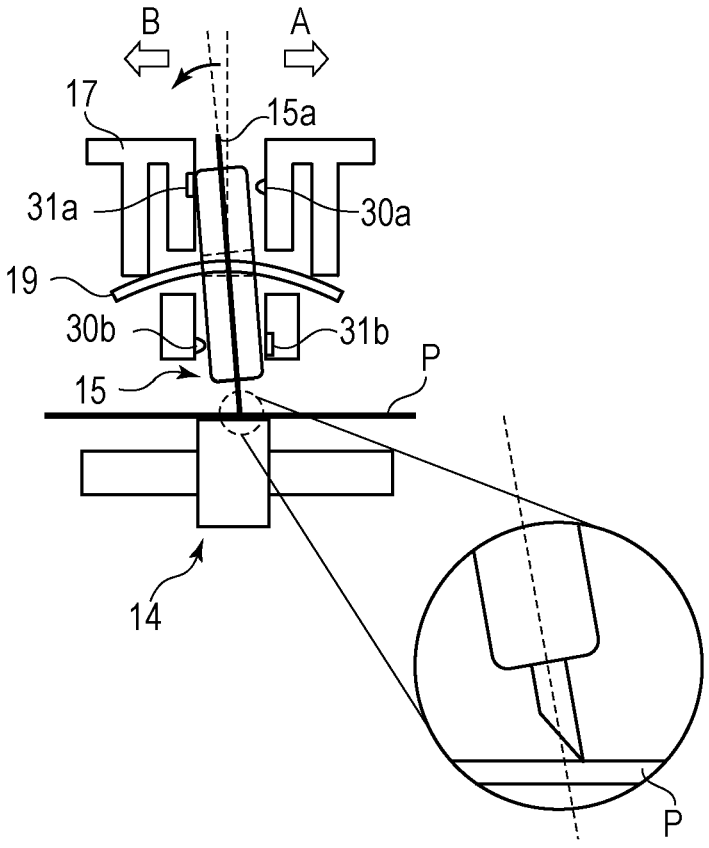
FIG. 3 is a detailed view illustrating the spur and associated elements (in a state where a sheet is being conveyed)

FIGS. 2A to 2C are detailed views illustrating the spur 15 and associated elements in a state where no sheet P is being conveyed. FIG. 2A is an enlarged view of part IIA encircled in FIG. 1. FIG. 2B is a front view seen in the direction of arrow IIB illustrated in FIG. 2A. FIG. 2C is a top view seen in the direction of arrow IIC illustrated in FIG. 2A. FIG. 3 is a detailed view illustrating the spur 15 and associated elements in a state where a sheet P is being conveyed. A side indicated by arrow A and corresponding to the right side in FIG. 3 is defined as side A (a first side), and a side indicated by arrow B and corresponding to the left side in FIG. 3 is defined as side B (a second side).

The spur 15, which is an idler rotating member, includes teeth 15*a* each made of a metal sheet and having a sharp edge 15*d*, and a spur body 15*b* made of resin and integrated with the teeth 15*a*. The spur body 15*b* has a hole 15*c* through which a shaft 19 extends.

The shaft 19 supports the spur 15 such that the spur 15 is rotatable about the shaft 19. That is, the shaft 19 functions as the center of rotation of the spur 15. The shaft 19 itself does not rotate but has elasticity for undergoing elastic deformation. When a sheet P is nipped between the spur 15 and the conveying roller 14, the shaft 19 undergoes elastic deformation as illustrated in FIG. 3 and presses the spur 15 against the sheet P. The shaft 19 extends through the spur 15 in a direction orthogonal to the spur 15 (in the axial direction). The hole 15*c* has a tapered shape with the inside diameter thereof being linearly reduced from the side A toward the side B.

The teeth 15*a* are provided over the entire circumference of the spur 15 and at a constant pitch. The teeth 15*a* each have a sharp edge 15*d* having a needle-like shape.

The edges 15*d* of the teeth 15*a* are provided on the first side with respect to a center line c-c of the spur 15. The reason why the edges 15*d* are offset from the center line c-c toward the side A is as follows.

As the error in the radius of a roller or the like that conveys the sheet P becomes smaller over the entire circumference of the roller or the like, the variation in the length of conveyance of the sheet P is reduced. This also applies to the spur 15. As the error in the radius of the spur 15 from each of the edges 15*d* to the center of the spur 15 becomes smaller, the variation in the length of conveyance of the sheet P is reduced. To reduce the error in the radius of the spur 15, edging or pressing is performed on the teeth 15*a* so as to form the edges 15*d*. In such a processing step, if the edges 15*d* are formed on the center line c-c, the error in the radius of the spur 15 increases. If the edges 15*d* are formed at a position that is offset from the center line c-c of the spur 15 toward the side A or toward the side B, the error in the radius of the spur 15 can be reduced. For these reasons, the teeth 15*a* each have an asymmetrical shape with the edge 15*d* thereof being offset from the center line c-c toward the side A.

The spur holder 17 fixedly holds the two ends of the shaft 19. The spur holder 17 has two projections 30*a* and 30*b* (first contact portions) that come into contact with respective portions (a portion near the upper right edge and a portion near the lower left edge in FIG. 3) of the spur body 15*b* when the spur 15 is about to incline toward the side A. In a state where the spur 15 is in contact with the first contact portions, the spur 15 stands substantially vertically to the surface of the sheet P while being prevented from inclining further toward the side A. Herein, the phrase "substantially vertically" does not necessarily mean "exactly vertically" and includes a state where the spur 15 inclines slightly toward the side B or toward the side A.

The spur holder 17 also has two contact portions 31*a* and 31*b* (second contact portions) that come into contact with respective portions (a portion near the upper left edge and a portion near the lower right edge in FIG. 3) of the spur body 15*b* when the spur 15 has inclined to the maximum toward the side B. The projection 30*a* comes into contact with the spur body 15*b* at a position above the shaft 19. The projection 30*b* comes into contact with the spur body 15*b* at a position below the shaft 19. The contact portion 31*a* comes into contact with the spur body 15*b* at a position above the shaft 19. The contact portion 31*b* comes into contact with the spur body 15*b* at a position below the shaft 19.

As described above, when seen from the downstream side in the direction of sheet conveyance, the spur 15 is rotatably supported by the spur holder 17 in such a manner as to be allowed to incline toward one side (the side B) but to be prevented from significantly inclining toward the opposite side (the side A). The inclination of the spur 15 that is in contact with the first contact portions is substantially vertical to the surface of the sheet P, and the spur 15 does not incline further toward the opposite side (the side A). This is because the inclination of the spur 15 at the contact with the first contact portions is smaller than that at the contact with the second contact portions.

As illustrated in FIG. 2C, the projections 30*a* and 30*b* are provided at positions that coincide with the shaft 19 when seen from above (in the direction orthogonal to the surface of the sheet P). That is, the projections 30*a* and 30*b* are provided at positions corresponding to the center of the spur 15. Since the projections 30 are provided at the positions corresponding to the center of the spur 15, the spur 15 can easily change its position if the spur 15 is not provided parallel to the direction of sheet conveyance. Therefore, the spur 15 can extend parallel to the direction of sheet conveyance. Since the spur 15 extends parallel to the direction of sheet conveyance, no extra pressing force is applied to the sheet P from the spur 15. Consequently, the formation of a spur mark in the sheet P and the deterioration in the conveyance accuracy are suppressed.

As illustrated in FIG. 3, while the sheet P is being conveyed, the spur 15 is pushed upward by the force of reaction to the nipping of the sheet P, whereby the shaft 19 undergoes elastic deformation. In FIG. 3, the deformation of the shaft 19 is exaggerated for deep understanding. While the sheet P is being conveyed, the spur 15 rotates by following the movement of the sheet P. The spur 15 receives a force acting in the axial direction from the sheet P while following the movement of the sheet P and tends to incline toward the side A or toward the side B. When the spur 15 is about to incline toward the side A, the spur 15 comes into contact with the projections 30*a* and 30*b* and is therefore prevented from further inclining toward the side A. Hence, while the sheet P is being conveyed, the spur 15 tends to incline toward the side B as illustrated in FIG. 3. Moreover, since the hole 15*c* has a tapered shape with the inside diameter thereof gradually changing, the inclination of the spur 15 toward the side B is promoted. The inside diameter of the hole 15*c* having a tapered shape is smaller on the side opposite the side toward which the spur 15 is easy to incline. That is, the inside diameter of the hole 15*c* is gradually reduced toward the side B. FIG. 4 is a table summarizing the relationship between the inclination of the spur 15 and the shape of the resultant spur mark made in the sheet P. The term "spur mark" refers to a mark that is made in the sheet P as a result of the edges 15*d* of the spur 15 coming into contact with and biting the sheet P. Herein, the length of the spur mark made by the spur 15 and in the direction of sheet conveyance is denoted by L. The spur mark is visually more noticeable as the length L becomes longer. The correlation between the inclination of the spur 15 and the resultant spur mark will now be evaluated on the basis of the length L. Note that the edges 15*d* are provided on the side A with respect to the center line c-c.

In a case where the spur 15 has inclined toward the side A with respect to the sheet P (a case in the rightmost column of the table illustrated in FIG. 4), the edges 15*d* tend to bite the sheet P deeply, leaving a spur mark having a length $L_1$, which is the largest of all cases. Furthermore, the spur mark having the length $L_1$ generally has an odd shape. Therefore, the spur mark tends to be visually noticeable (the spur mark having the length $L_1$ is evaluated as NG). In contrast, the spur 15 that has inclined toward the side B with respect to the sheet P (a case in the leftmost column of the table illustrated in FIG. 4) leaves a spur mark having a length $L_2$ that is smaller than the length $L_1$, and the spur mark having the length $L_2$ is generally smaller than the spur mark having the length L. Therefore, the spur mark having the length $L_2$ is less noticeable (the spur mark having the length $L_2$ is evaluated as OK). The spur 15 that stands vertically with respect to the sheet P (a case in the center column of the table illustrated in FIG. 4) leaves a spur mark having a length $L_0$ that is smaller than the length $L_1$, and the spur mark having the length $L_0$ is less noticeable than the spur mark having the length $L_1$ (the spur mark $L_0$ is evaluated as OK). That is, if the spur 15 is prevented from inclining significantly toward the side A, the spur mark can be made smaller.

In view of the above findings, the inclination of the spur 15 at the contact with the projections 30 is set to a smaller value than the inclination of the spur 15 at the contact with the contact portions 31 (hereinafter also referred to as flat portions 31). That is, the spur 15 is rotatably supported by the spur holder 17 in such a manner as to be allowed to incline toward one side but to be prevented from inclining toward the opposite side by using a mechanically biasing structure.

As described above, when seen from the downstream or upstream side in the direction of sheet conveyance, the sharp teeth 15*a* of the spur 15 each have an asymmetrical shape with one side thereof toward which the spur 15 inclines sloping but with the opposite side thereof not sloping. Such a shape in which only one side of the tooth 15*a* has been cut obliquely can be formed by obliquely grinding only the one side of the tooth 15*a* in the edge forming step. Thus, the edges 15*d* can be formed easily, realizing both a reduction in the manufacturing cost and an increase in the manufacturing accuracy. If both of the two sides of each tooth 15*a* are ground obliquely, the grinding step needs to be performed twice, reducing the manufacturing efficiency and increasing the manufacturing cost correspondingly.

Figure 5:
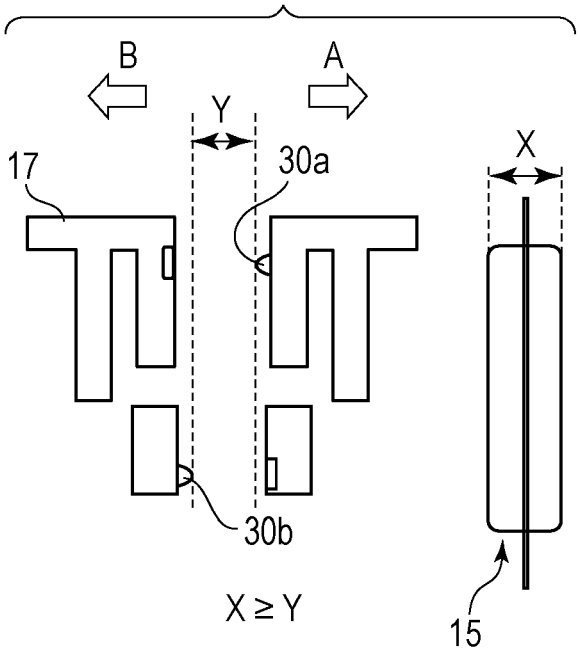
FIG. 5 illustrates the dimensional relationship between the spur and a spur holder.

FIG. 5 illustrates the dimensional relationship between the spur 15 and the spur holder 17. Letting the width of the spur 15 be X and the distance between the head of the projection 30*a* and the head of the projection 30*b* be Y, a relationship of $X \geq Y$ holds. That is, the spur 15 stands vertically with respect to the sheet P (X=Y) or inclines toward the side B (X>Y). Thus, the reduction in the size of the spur mark is promoted. The inclination of the spur 15 toward the side A can be prevented if at least one of the projections 30*a* and 30*b* is provided.

Figure 6A:
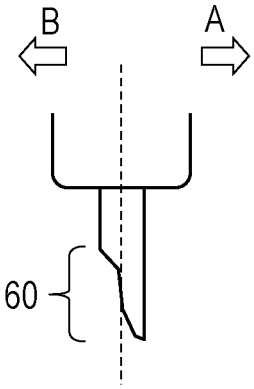
FIGS. 6A to 6C illustrate exemplary shapes of a tooth of the spur.
Figure 6B:
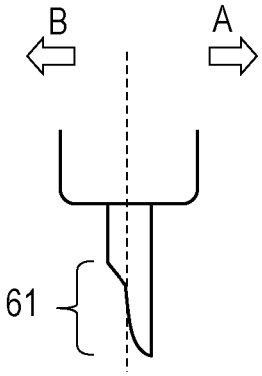
Figure 6C:
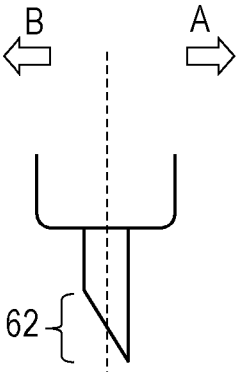

FIGS. 6A to 6C illustrate exemplary shapes of each tooth 15*a* of the spur 15 seen from the downstream or upstream side in the direction of sheet conveyance. The shape of each tooth 15*a* of the spur 15 only needs to be asymmetrical with the edge 15*d* thereof being offset from the center line c-c toward the side A. Examples of the asymmetrical shape include the following: a shape formed of a plurality of sloping surfaces 60 (FIG. 6A), a shape formed of a plurality of sloping surfaces 61 with one of which being a curved surface (FIG. 6B), and a shape formed of a single sloping surface 62 (FIG. 6C). These exemplary shapes each include sloping surfaces only on one side, with the opposite side (the side A) having no sloping surfaces. The present invention is not limited to such a case. Any sloping surfaces whose inclinations are very small may also be formed on the opposite side. That is, the tooth 15*a* of the spur 15 only needs to have an asymmetrical shape when seen from the downstream or upstream side in the direction of sheet conveyance with any sloping surfaces on the side B being at larger angles than any sloping surfaces on the side A.

As described above, the spur 15 as an idler rotating member includes the teeth 15*a* provided around the circumference thereof at a constant pitch, and the teeth 15*a* each have the needle-like sharp edge 15*d*. With the rotation of the spur 15 during the conveyance of the sheet P, a spur mark is formed as a straight dotted line in the surface of the sheet P.

The shape of the idler rotating member is not limited to such a shape. For example, the idler rotating member may have a thin, circular, disc-like shape with a sharp edge extending along the entirety of the virtual circle illustrated by the dotted line in FIG. 2A. In such a case, the edge of the idler rotating member is in line contact with the surface of the sheet P with the rotation of the idler rotating member. Therefore, a thin linear spur mark is formed in the surface of the sheet P. For another example, the idler rotating member may have an edge with recesses provided at regular intervals over the entire circumference thereof. In such a case, the edge of the idler rotating member is intermittently in line contact with the surface of the sheet P with the rotation of the idler rotating member. Therefore, a thin, broken-line spur mark is formed in the surface of the sheet P. The mechanism of formation of the spur mark that has been described above with reference to FIG. 4 applies to any of such cases.

While the first embodiment concerns a case where the hole 15*c* has a tapered shape, the present invention is not limited to such a case. The hole 15*c* may have a constant inside diameter. In that case, however, the hole 15*c* has an inside diameter that allows the spur 15 to incline to the maximum toward the side B.

The dimensions of the spur 15 and the spur holder 17 do not necessarily satisfy the relationship of $X \geq Y$ described above, as long as the inclination of the spur 15 at the contact with the projections 30 is smaller than the inclination of the spur 15 at the contact with the flat portions 31. The center of gravity of the spur 15 may be defined on the side B with respect to the center line c-c so that the spur 15 can easily incline toward the side B.

While the first embodiment concerns a case where the edges 15*d* are provided on the side A with respect to the center line c-c, the present invention is not limited to such a case. For example, the edges 15*d* may be provided on the side B with respect to the center line c-c. In such a case, the positions of the projections 30 and the positions of the flat portions 31 can be exchanged so that the spur 15 is prevented from inclining toward the side B.

According to the first embodiment, the spur 15 (a rotating member) is rotatably supported such that, when seen from the downstream or upstream side in the direction of sheet conveyance, the spur 15 is allowed to incline toward one side but is prevented from inclining toward the opposite side. Furthermore, the teeth 15*a* of the spur 15 each have an asymmetrical shape with a larger inclination on the one side than on the opposite side. Therefore, as described above with reference to FIG. 4, the spur 15 does not incline significantly toward the opposite side (the side A) and does not leave a noticeable spur mark with less damage to the sheet P. That is, if a member that supports the spur 15 has a mechanically biasing structure that intentionally causes the spur 15 to incline toward one side in accordance with the asymmetrical shape of the teeth 15*a* of the spur 15, the size of the resultant spur mark formed in the sheet by the spur 15 is reduced. Consequently, the damage to the sheet P is reduced.

In the interpretation of the present invention, the phrase "to prevent the spur 15 from inclining toward the opposite side" or the like encompasses a case where the spur 15 standing vertically is allowed to incline only slightly toward the opposite side within a range in which the advantageous effect of the present invention is produced. The present invention is intended to provide a mechanically biasing structure that helps the spur easily incline toward a predetermined side. A slight inclination of the spur toward the opposite side during sheet conveyance is acceptable as long as the inclination is smaller than that toward the predetermined side.

Second Embodiment

Figure 7:
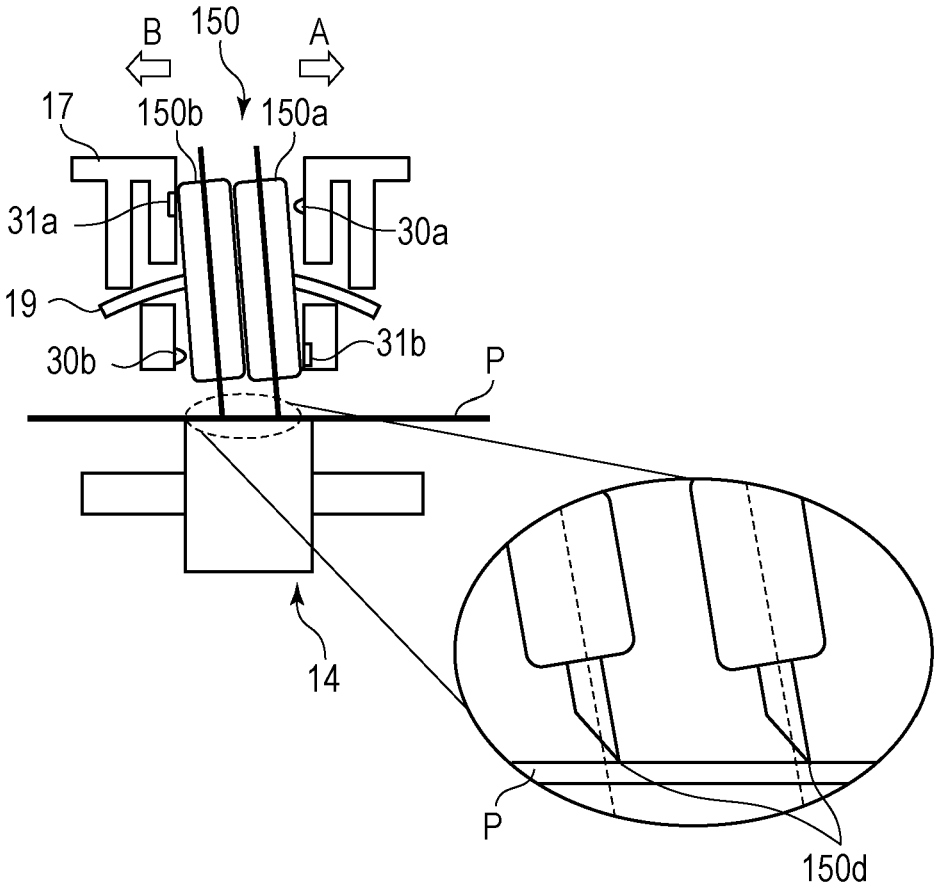
FIG. 7 is a detailed view illustrating a spur unit and associated elements according to a second embodiment.

FIG. 7 is a detailed view illustrating a spur unit 150 and associated elements according to a second embodiment. The second embodiment differs from the first embodiment in that one spur holder supports a plurality of spurs by using one common shaft.

In the spur unit 150, one spur holder 17 supports spurs 150*a* and 150*b* by using a common shaft 19. Edges 150*d* of teeth of the spurs 150*a* and 150*b* are provided on the side A with respect to the centers of the spurs 150*a* and 150*b*, as in the first embodiment. The spur unit 150 may include three or more spurs that are supported by one shaft.

To convey the sheet P with high accuracy, a predetermined pressing force needs to be applied from the spur to the sheet P. If the pressing force from the spur is too large, a noticeable spur mark may be formed in the sheet P. Hence, the spurs 150*a* and 150*b* are provided on one shaft 19 so that the area of contact between the sheet P and the edges 150*d* is increased, whereby a desirable pressing force can be produced. Thus, the size of the spur mark can be reduced while high conveyance accuracy is maintained.

During the conveyance of the sheet P, the spur 150*a* is prevented from inclining toward the side A by the projection 30*a* and comes into contact with the spur 150*b* that is prevented from inclining by the projection 30*b*, whereby the inclination of the spur 150*a* toward the side A is further prevented. On the other hand, the spur 150*b* is prevented from inclining toward the side A by the projection 30*b* and comes into contact with the spur 150*a* that is prevented from inclining by the projection 30*a*, whereby the inclination of the spur 150*b* toward the side A is further prevented.

According to the second embodiment, the same advantageous effect as in the first embodiment is produced. Furthermore, the spur holder 17 supports the plurality of spurs 150*a* and 150*b* (rotating bodies) of the same shape by using the common shaft 19. Therefore, the size of the spur mark can be reduced while high conveyance accuracy is maintained.

Third Embodiment

Figure 8:
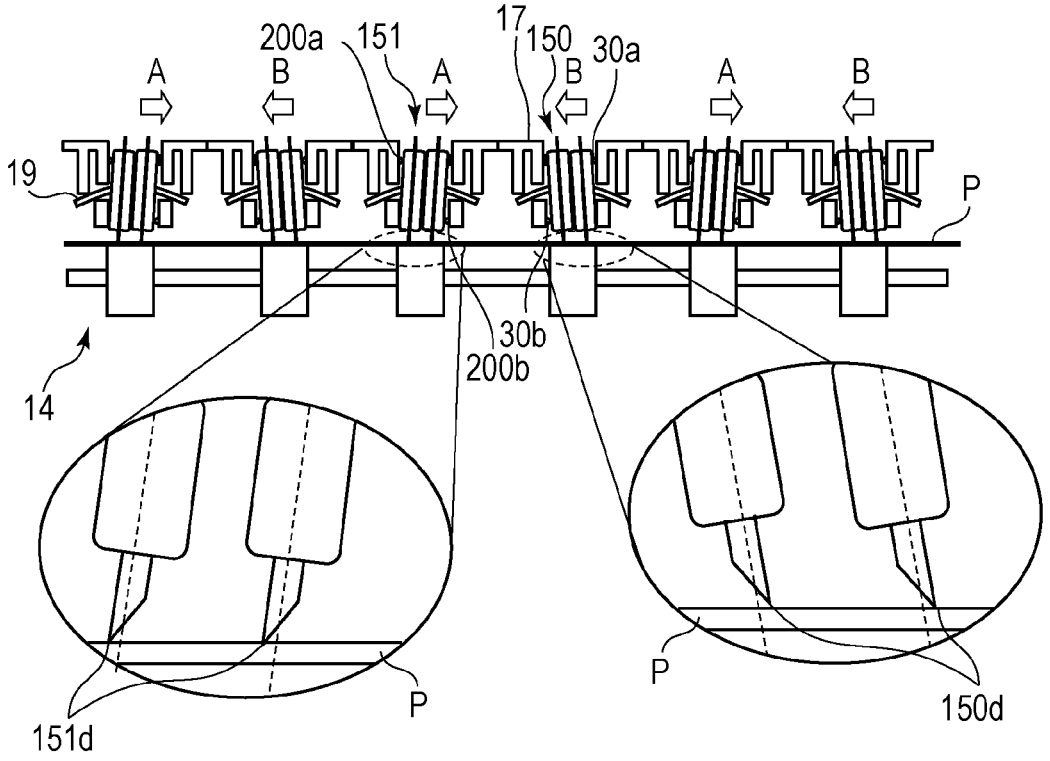
FIG. 8 is a detailed view illustrating spur units and associated elements according to a third embodiment.

FIG. 8 is a detailed view illustrating spur units and associated elements according to a third embodiment that are seen from the downstream side in the direction of sheet conveyance. In the third embodiment, a plurality of spur units, each of which corresponds to the spur unit 150 according to the second embodiment, are arranged in a line. The spur units arranged in a line do not all incline toward the same side. The side toward which the spur units incline varies regularly.

Spur units 150 each have the same configuration as the spur unit 150 according to the second embodiment. That is, the edges 150*d* are provided on the side A with respect to the center line c-c, and the spur unit 150 is prevented from inclining toward the side A by the projections 30*a* and 30*b*. Therefore, the spur unit 150 can easily incline toward the side B.

Spur units 151 each have teeth 151*d* provided on the side B with respect to the center line c-c, and is prevented from inclining toward the side B by projections 200*a* and 200*b*. Therefore, the spur unit 151 can easily incline toward the side A.

If all of the plurality of spur units are configured to incline toward the side B, the skew of the sheet P during the sheet conveyance may be promoted. Hence, to avoid the skew of the sheet P, at least some of the spur units are configured to incline toward the opposite side, that is, the direction of inclination of the spur units is not unified. For example, as illustrated in FIG. 8, it is preferable that the direction of inclination of the spur units be changed alternately.

The present invention is not limited to the above cases. A plurality of spurs, instead of spur units, may be arranged in a line in the axial direction, with the direction of inclination of the spurs being changed alternately.

According to the third embodiment, the same advantageous effect as in the first embodiment is produced. Furthermore, a plurality of spurs are arranged in a line with the direction of inclination thereof being varied. Therefore, the degree of skew of the sheet P during sheet conveyance is reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-003878, filed Jan. 14, 2014, which is hereby incorporated by reference herein in its entirety.

What is claimed is:

1. A conveying device comprising:

a rotating member having sharp teeth and configured to rotate while being in contact with an object that is being conveyed; and a holder configured to support the rotating member, wherein the holder holds a shaft that supports the rotating member such that the rotating member is allowed to rotate, wherein, when seen from a downstream side in a direction of sheet conveyance, the rotating member is rotatably supported by the holder such that the rotating member is allowed to incline toward one side but is prevented from inclining toward an opposite side, and each of the teeth of the rotating member has an asymmetrical shape with the one side thereof sloping, wherein the holder includes a first contact portion with which a portion of the rotating member comes into contact when the rotating member is about to incline toward the opposite side, and a second contact portion with which a portion of the rotating member comes into contact when the rotating member has inclined to the maximum toward the one side, and wherein the first contact portion is a flat portion, and the second contact portion is a projection.

2. The conveying device according to claim 1, wherein the projection is provided at a position that coincides with the shaft when seen from above.

3. A conveying device comprising:

a rotating member having sharp teeth and configured to rotate while being in contact with an object that is being conveyed; and a holder configured to support the rotating member, wherein the holder holds a shaft that supports the rotating member such that the rotating member is allowed to rotate, wherein, when seen from a downstream side in a direction of sheet conveyance, the rotating member is rotatably supported by the holder such that the rotating member is allowed to incline toward one side but is prevented from inclining toward an opposite side, and the each of the teeth of the rotating member has an asymmetrical shape with the one side thereof sloping, wherein the holder includes a first contact portion with which a portion of the rotating member comes into contact when the rotating member is about to incline toward the opposite side, and a second contact portion with which a portion of the rotating member comes into contact when the rotating member has inclined to the maximum toward the one side, and wherein the rotating member has a hole having a tapered shape and through which the shaft extends, and an inside diameter of the hole having the tapered shape is smaller on the one side than on the opposite side.

4. The conveying device according to claim 1, wherein the rotating member is each of a plurality of rotating bodies that are supported by the holder with a common shaft, the plurality of rotating bodies having the same shape and being configured to incline toward the same side.

5. The conveying device according to claim 1, wherein the rotating member is each of a plurality of rotating bodies that are arranged in a line, and the side toward which the plurality of rotating bodies incline varies.

6. A printing apparatus comprising:

the conveying device according to claim 1, wherein the object is a sheet on which printing is performed by a printing section.

7. A printing apparatus comprising:

the conveying device according to claim 3, wherein the object is a sheet on which printing is performed by a printing section.

* * * * *